US006904703B2

(12) United States Patent
Naganawa et al.

(10) Patent No.: US 6,904,703 B2
(45) Date of Patent: Jun. 14, 2005

(54) DRY CLEANING MACHINE

(75) Inventors: Mitsuru Naganawa, Moriguchi (JP); Masafumi Nishino, Moriguchi (JP); Keiji Kitamura, Moriguchi (JP)

(73) Assignees: Sanyo Electric Co., Ltd., Moriguchi (JP); Sanyo Electric Techno Clean Co., Ltd., Moriguchi (JP)

( * ) Notice: Subject to any disclaimer, the term of this patent is extended or adjusted under 35 U.S.C. 154(b) by 75 days.

(21) Appl. No.: 10/418,285

(22) Filed: Apr. 18, 2003

(65) Prior Publication Data

US 2004/0010937 A1 Jan. 22, 2004

(30) Foreign Application Priority Data

Apr. 23, 2002 (JP) ..... 2002-121057

(51) Int. Cl.[7] ..... F26B 11/02
(52) U.S. Cl. ..... 34/596; 68/18 R
(58) Field of Search ..... 34/595, 596, 597, 34/598, 599, 600; 134/10, 12; 68/18 R

(56) References Cited

U.S. PATENT DOCUMENTS 3,978,694 A * 9/1976 Hughes et al. ..... 68/18 R
4,112,590 A * 9/1978 Muller ..... 34/75
5,146,693 A * 9/1992 Dottor et al. ..... 34/77
5,327,751 A * 7/1994 Biagi ..... 68/18 C
5,469,876 A * 11/1995 Gray et al. ..... 134/105
5,887,456 A * 3/1999 Tanigawa et al. ..... 68/20
6,004,403 A * 12/1999 Gray et al. ..... 134/10
6,116,060 A * 9/2000 Strader ..... 68/20
6,272,770 B1 * 8/2001 Slutsky et al. ..... 34/596

FOREIGN PATENT DOCUMENTS

JP 2002-119797 4/2002

* cited by examiner

*Primary Examiner*—Stephen Gravini
(74) *Attorney, Agent, or Firm*—Oliff & Berridge, PLC

(57) ABSTRACT

In the dry clearing machine, a common refrigerator is used for both the solvent cooler and the drying cooler, and the coolant compressed and liquefied in the refrigerator is supplied either one of the heat exchanger of the solvent cooler or that of the drying cooler, depending on the state of a switch. In the heat exchanger selected by the switch, the coolant is supplied and the solvent or the air is cooled when the coolant evaporates. That is, only the cooler selected by the switch works, but the other cooler not selected by the switch does not work. While the laundry is washed, normally, it is not necessary to supply air to the outer tub through the air path, and the drying cooler need not be operated. Thus, in the process of washing, the solvent is adequately cooled because an enough amount of coolant is supplied to the solvent cooler, and the temperature rise of the solvent is prevented.

6 Claims, 5 Drawing Sheets

Fig. 3

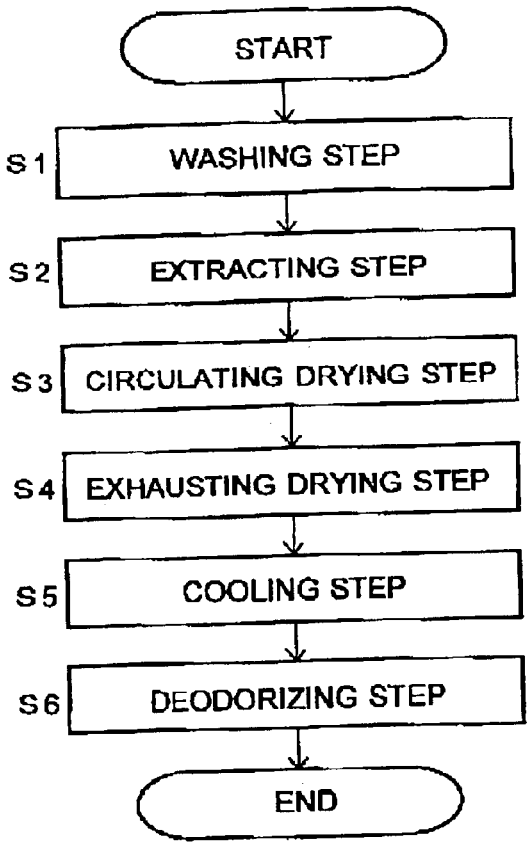

Fig. 4

| STEP | COOLANT FLOWS TO: | REFRIGERATOR IS USED FOR: |
|---|---|---|
| WASHING | SOLVENT COOLER, WHEN NECESSARY | COOLING SOLVENT, WHEN NECESSARY |
| EXTRACTING | SOLVENT COOLER, WHEN NECESSARY | COOLING SOLVENT, WHEN NECESSARY |
| CIRCULATING DRYING | DRYING COOLER | RETRIEVING SOLVENT |
| EXHAUSTING DRYING | SOLVENT COOLER OR DRYING COOLER | COOLING SOLVENT OR RETRIEVING SOLVENT |
| COOLING | DRYING COOLER | COOLING LAUNDRY |
| DEODORIZING | (DOES NOT FLOW) | (NOT USED) |

DRY CLEANING MACHINE

BACKGROUND OF THE INVENTION

A known dry cleaning machine includes a solvent circulating path with the inlet at the bottom of the outer tub, which contains a rotating drum, and the outlet at the top of the outer tub. In the solvent circulating path, a pump and a filter are provided. In such a dry cleaning machine, the solvent is circulated through the circulating path by the pump and is cleaned by the filter while the laundry is washed Thus the solvent is not discharged from the dry cleaning machine and is repeatedly used.

Petroleum solvent, for example, shows the best washing performance when it is around 25° C., and the washing efficiency decreases at higher or lower temperatures. Since the petroleum solvent has a rather low firing point, it bears safety problems when the temperature rises. In the above structure using the solvent circulating system, the temperature of the solvent changes due to the heat transfer from the surroundings, and the temperature rises due to the heat transfer from the pump and functions with the circulating path. In conventional dry cleaning machines, a cooler or a heater is provided in the circulating path, and they are controlled to maintain the temperature of the solvent at around 25° C.

In normal conventional dry cleaning machines, besides the cooler for cooling the solvent, another cooler is provided for condensing, liquefying and recirculating the solvent evaporated from the laundry while it is dried. Thus, generally, two coolers are provided in conventional dry cleaning machines.

The applicant of the present invention proposed a new type of dry cleaning machine, which is disclosed in the Published Unexamined Japanese Patent Application No. 2002-119797, etc. In the dry cleaning machine, a solvent cooler with a solvent pipe is placed between the heater for heating the air, which is supplied to the outer tub while drying, and a drying cooler for condensing the solvent gas. In this structure, the air cooled by the drying cooler exchanges heat with the solvent pipe, so that the solvent is cooled. Thus, in this structure, the cooler for cooling the solvent is no more necessary, which lowers the cost of the machine.

The dry cleaning machine works without problem when the ambient temperature is rather low. When, however, the ambient temperature is very high, in summer for example, the temperature of the solvent tends to increase due to the heat transfer from the surroundings. In such a case, the cooling performance of the coolers is not enough even if the cooler is operated at its largest capacity. The temperature of the solvent may, in some cases, exceed 30° C.

The present invention addresses the problem, and one of the primary objectives of the present invention is to provide a dry cleaning machine in which the solvent can be maintained at the adequately low temperature even when the conditions are severe, for example the ambient temperature is high.

SUMMARY OF THE INVENTION

According to the first dry cleaning machine of the present invention includes:

- an outer tub functioning as a washing chamber and a drying chamber;
- a solvent circulating system for supplying solvent to the outer tub for washing while washing laundry and for retrieving the solvent;

- an air path connecting an air outlet and an air inlet of the outer tub for supplying heated air to the outer tub and for retrieving the air from the outer tub;
- a refrigerator for compressing and liquefying a coolant;
- a solvent cooler placed outside of the outer tub equipped with a heat exchanger for cooling the solvent using the coolant;
- a drying cooler provided in the air path for cooling the air passing through the air path and for condensing the solvent included in the air using the coolant;
- a coolant circulating system including a switch for supplying the coolant liquefied in the refrigerator selectively either to the solvent cooler or the drying cooler.

In the above first dry cleaning machine, a common refrigerator is used for both the solvent cooler and the drying cooler, and the coolant compressed and liquefied in the refrigerator is supplied either one of the heat exchanger of the solvent cooler or that of the drying cooler, depending on the state of the switch. The coolant is supplied to the heat exchanger selected by the switch, in which the solvent or the air is cooled when the coolant evaporates. That is, only the cooler selected by the switch works, but the other cooler not selected by the switch does not work While the laundry is washed, normally, it is not necessary to supply air to the outer tub through the air path, and the drying cooler needs not be operated. Thus, in the process of washing, the solvent is adequately cooled because an enough amount of coolant is supplied to the solvent cooler, and the temperature rise of the solvent is prevented.

By designing the heat exchanging performance of the solvent cooler and that of the drying cooler to be almost the same, the liquefied coolant adequately becomes low-temperature, low-pressure gas and returns to the refrigerator whichever cooler is used. Thus the coolant is prevented from returning to the refrigerator in a liquefied state, and an overload on the compressor of the refrigerator is appropriately prevented. Since the coolant adequately drives the solvent or the air of heat, frosting on the pipes in the heat exchangers is prevented. Since, further, one refrigerator is shared by two coolers, the cost of the dry cleaning machine can be reduced, and the space efficiency in the dry cleaning machine is enhanced.

Normally, the solvent cooler has a larger cooling capacity than the drying cooler. When the ambient temperature is very high, in mid-summer for example, and the temperature of the solvent rises, the solvent cooler can adequately cool the solvent until it becomes the optimal temperature for washing. Thus the dry cleaning machine of the present invention is unaffected by the ambient temperature and can always achieve the maximum washing efficiency, as well as higher safety, preventing ignition of the solvent for sure.

When on/off switching is done frequently, heat pump type refrigerators generally deteriorate due to an overload imposed on the compressor. It is therefore desirable to switch on/off with enough intervals.

Thus the second dry cleaning machine of the present invention further comprises, in addition to the first one:

- an air heater placed in the air path at a downstream of the drying cooler;
- a closable air intake placed between the drying cooler and the air heater;
- an air exit placed in the air path at an upstream of the drying cooler;
- a gate valve placed between the drying cooler and the air intake;
- an operation controller for performing processes of circulating dying step for drying the air and for retrieving the solvent contained in the air by opening the gate valve, closing the air intake and energizing the heater and the drying cooler to dry the air passing through the air path, exhausting drying step for drying air by opening the air intake, heating an outer air taken from the air intake, supplying the heated air to the outer drum tough the air inlet, and discharging all or most of the air that has passed through the outer drum through the air exit, and cooling step for cooling the laundry by opening the gate valve, closing the air intake, de-energizing the heater, energizes the drying cooler, supplying cool air from the air inlet to the outer tub, wherein the operation controller detects the temperature of the solvent when the exhausting drying step starts, and sets the switch so that the coolant is supplied to the solvent cooler when the detected temperature is higher than a predetermined value, and the coolant is supplied to the drying cooler when the detected temperature is not higher than the predetermined value.

In the processes of circulating drying step-exhausting drying step-cooling step, the drying cooler needs to be operated in the circulating drying step and in the cooling step. But, in the exhausting drying step between them, neither the drying cooler nor the solvent cooler needs to be operated. In the second dry cleaning machine, however, the refrigerator is operated even in the exhausting drying step, and either one of the drying cooler and the solvent cooler is continued its operation. Thus, the refrigerator never stops even when the exhausting drying step is short, so that it is assured that any off-time of the refrigerator is longer than a predetermined period. Since the refrigerator is continuously operated in the exhausting drying step, the on-time of the refrigerator can also be assured longer than a predetermined period even if the cooling step is short. These prevents overloads to the compressor of the refrigerator, and the life of the refrigerator is prolonged in the second dry cleaning machine.

When, in the exhausting drying step, the temperature of the solvent is relatively high, the solvent cooler is operated in the second dry cleaning machine. This assures low temperature of the solvent, which brings better washing efficiency in the following washing step, and higher safety relating to the solvent. If, on the other hand, the temperature of the solvent is relatively low, there is no need to further lower the solvent temperature. In this case, the drying cooler is operated to efficiently retrieve solvent contained only a small amount in the air discharged from the outer tub. This enhances the solvent retrieval ratio, and also this has an advantage in protecting the environment because less amount of solvent is discharged outside with the air.

When, in the exhausting drying step, the drying cooler is operated while the amount of air returning to the drying cooler is small, the retrieval efficiency of the solvent is low. When, on the other hand, the drying cooler is not operated (but the solvent cooler is operated) in the exhausting drying step while the amount of air returning to the drying cooler is large, the drying cooler is warmed by the air, and the following cooling step is not properly performed because the air is not adequately cooled.

Thus, the third dry cleaning machine of the present invention is constructed as follows. In the exhausting drying step of the second dry cleaning machine, the operation controller drives the gate valve to shut the air path when the detected temperature is higher than the predetermined value and the coolant is supplied to the solvent cooler, and the operation controller drives the gate valve to open the air path when the detected temperature is not higher than the predetermined value and the coolant is supplied to the drying cooler.

According to this structure, the gate valve is closed when the drying cooler is not operate, and all the air discharged from the outer tub is then discharged outside from the air exit, so that the drying cooler is prevented from being warmed. When, on the other hand, the drying cooler is operated, the gate valve is opened and a part of the air discharged from the outer tub is not discharged from the air exit but flows to the drying cooler, so that the air is cooled and the solvent contained in the air is condensed and retrieved.

The fourth dry cleaning machine according to the present invention further includes, in addition to any one of the foregoing first to third dry cleaning machines:

a solvent detector for detecting whether the solvent remains in the outer tub; and the solvent circulating system comprises a solvent tank, a first path for retrieving the solvent discharged from the outer tub to the solvent tank through the solvent cooler, and a second path for taking the solvent out of the solvent tank and for returning the solvent to the solvent tank through the solvent cooler; and the fist path and the second path are selectively used depending on the result of the detection whether the solvent remains in the outer tub when the solvent is discharged from the outer tub and is retrieved to the solvent tank in the eating step (where the solvent is removed from the laundry by the centrifugal force generated by the high speed spinning of the cylindrical drum in the outer tub).

At the beginning of the extracting step, a large amount of solvent is discharged from the laundry, and the solvent is discharged from the outer tub, passes the solvent cooler, is cooled there, and collected by the solvent tank. Then, when the amount of the solvent discharged from the laundry becomes small, less solvent passes the solvent cooler. In that case, the heat load on the heat exchanger of the solvent cooler decreases, and the coolant hardly evaporates in the heat exchanger. The pipes in the heat exchanger gather frost, and the un-evaporated liquid coolant returns to the refrigerator, which imposes an excess burden on it.

In the fourth dry cleaning machine of the present invention, on the contrary, when the solvent detector detects that the solvent does not exist in the outer tub, the solvent path is switched from the first path to the second path, and the solvent sucked from the solvent tank is supplied to the solvent cooler. Thus the solvent is almost continuously sent to the solvent cooler in the extracting step, and the coolant is adequately evaporated in the heat exchanger. This prevent hosting on the pipes in the heat exchanger, and the excessive burden on the refrigerator is prevented because liquid solvent does not return to it.

BRIEF DESCRIPTION OF THE DRAWINGS

FIG. 3 is a flowchart illustrating the cleaning process of the drycleaner.

FIG. 4 is a table showing the flow the coolant and the purposes of the operation of the refrigerator in each step.

DETAILED DESCRIPTION OF A PREFERRED EMBODIMENT

Figure 1:
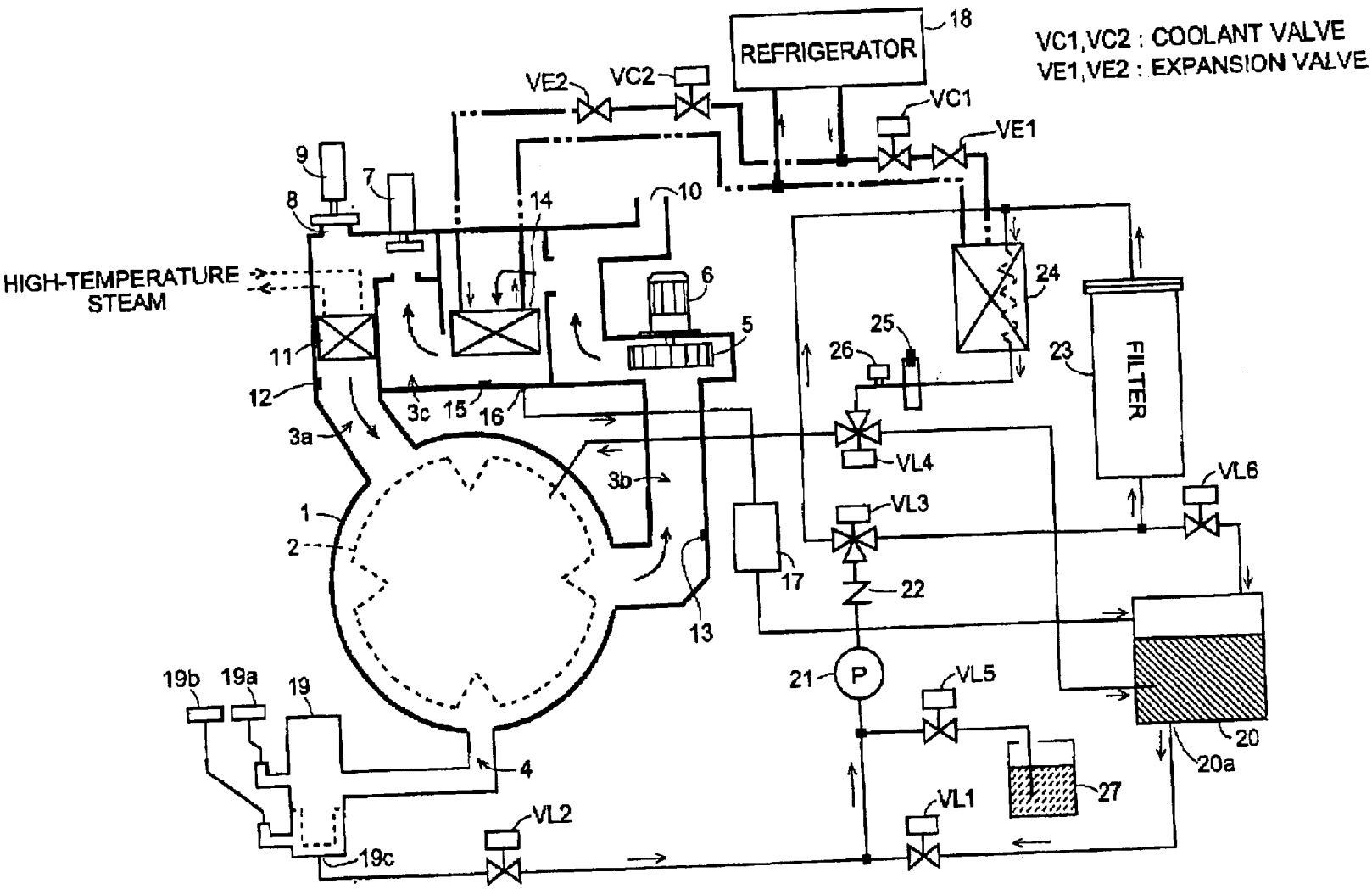
FIG. 1 is a schematic piping diagram of a drycleaner embodying the present invention.
Figure 2:
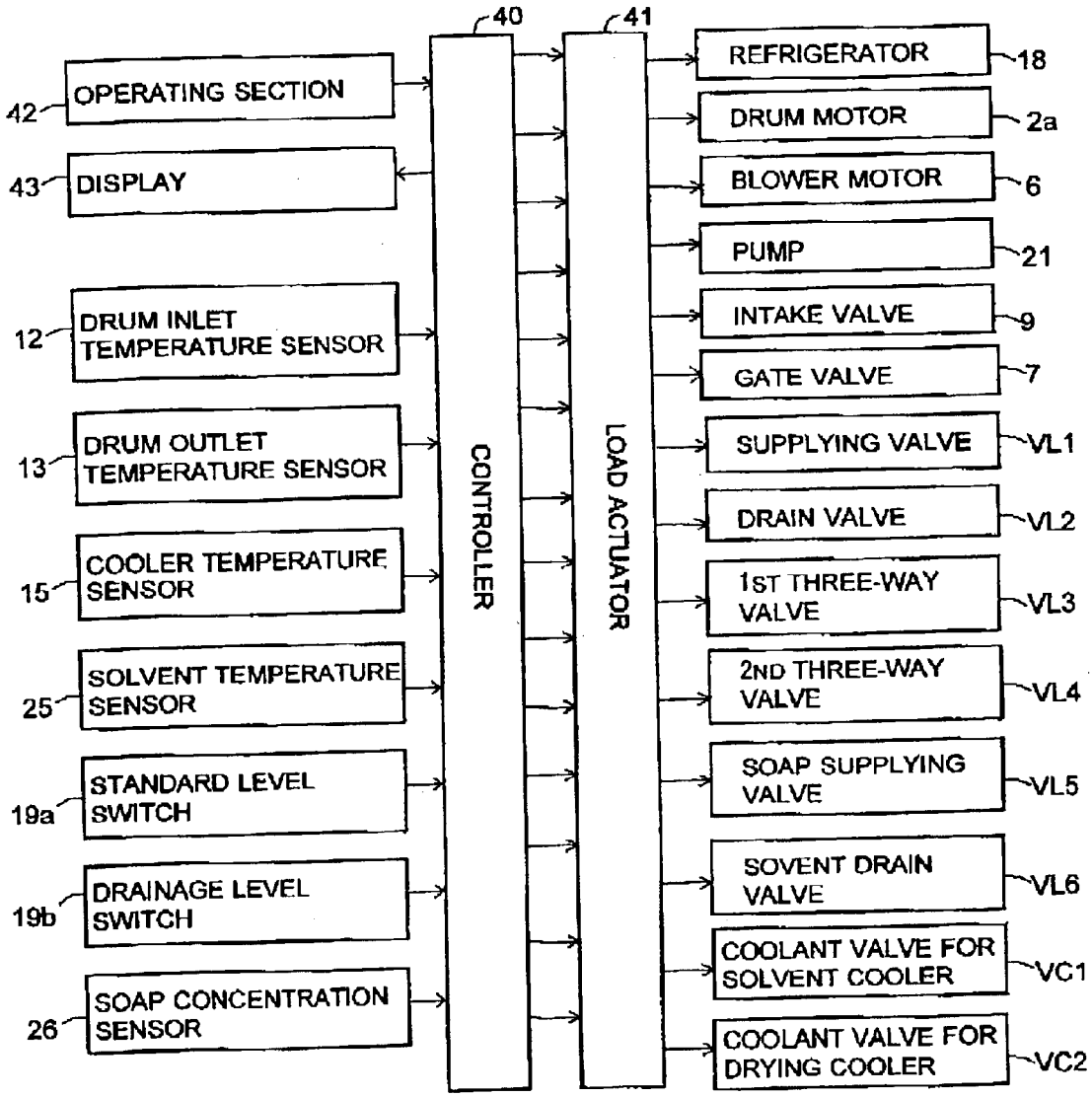
FIG. 2 is a block diagram illustrating the electric system of the drycleaner of the embodiment.
Figure 5:
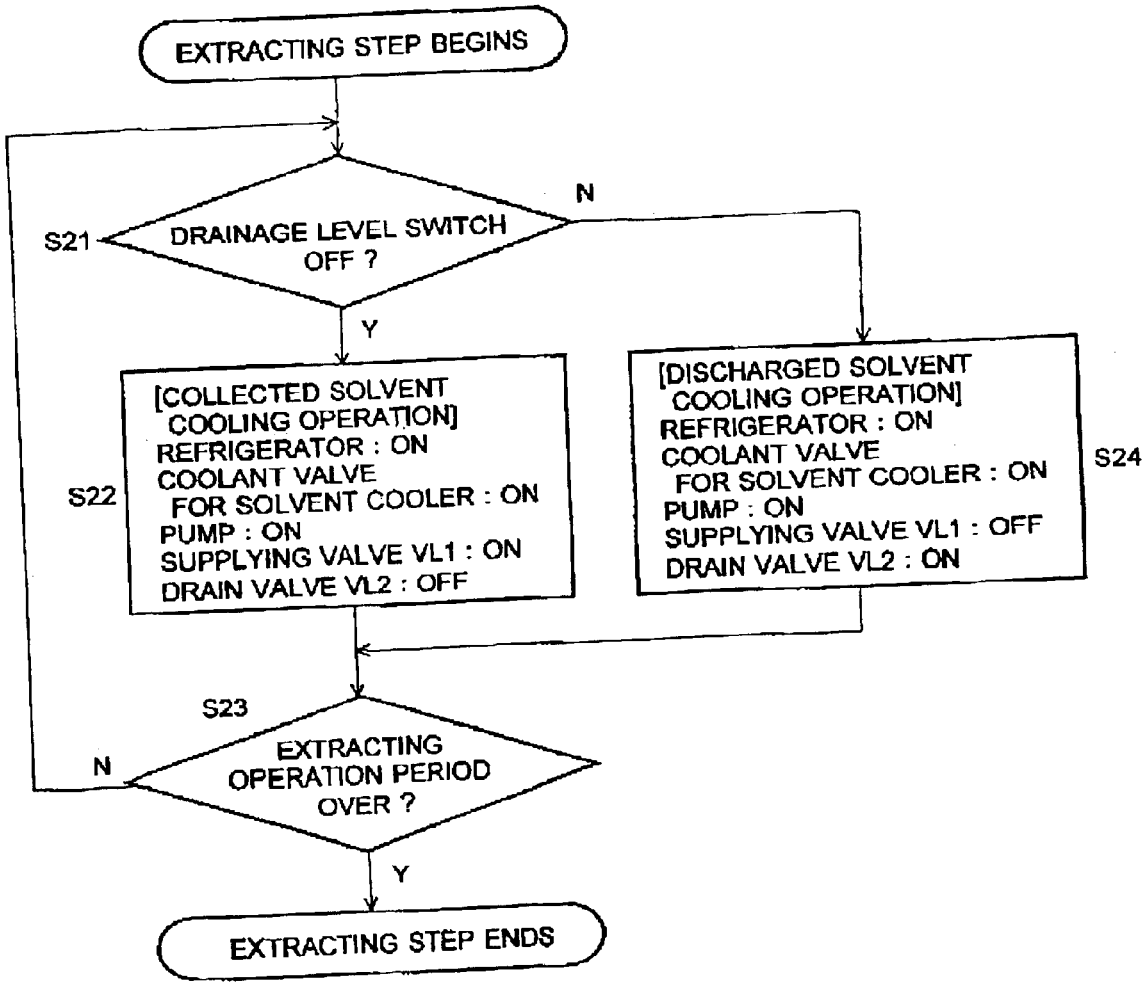
FIG. 5 is a flowchart of the main part of the extracting step of the drycleaner of the embodiment.
Figure 6:
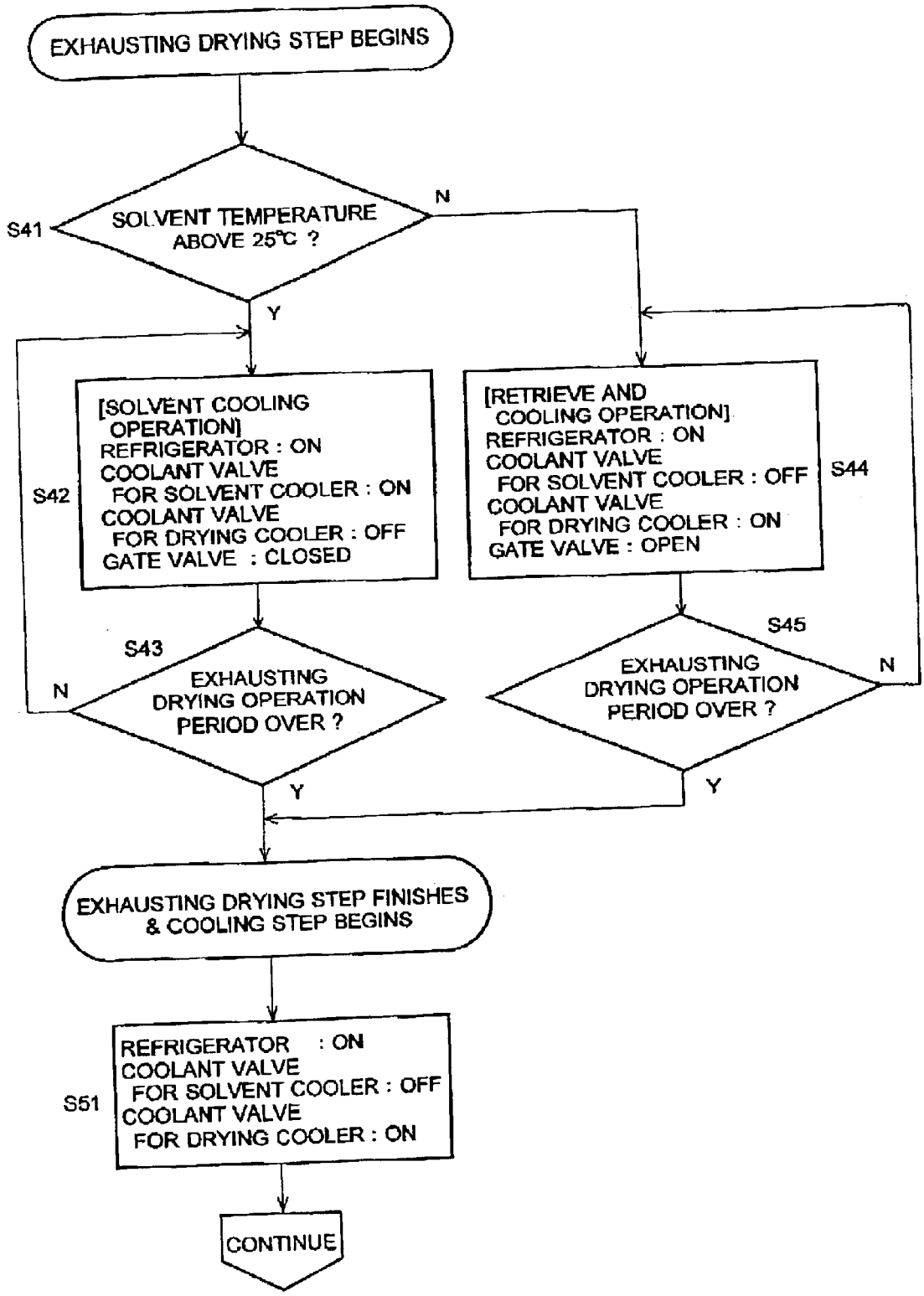
FIG. 6 is a flowchart of the part of an exhausting drying step of the drycleaner of the embodiment.

An embodiment of a drycleaner according to the present invention is described in reference to FIG. 1 to FIG. 6. In FIG. 1, there is shown a construction of relevant parts focusing on a piping diagram of this drycleaner. FIG. 2 illustrates its electric system. FIG. 3 is a flowchart illustrating cleaning process of the drycleaner. FIG. 4 is a table showing where coolant passages are connected to and purposes of refrigerator use in each step. FIG. 5 is a flowchart of the extracting step in its parts. FIG. 6 is a flowchart of an exhausting drying step in its main parts.

Referring first to FIG. 1, the structure of this drycleaner with a focus on its solvent flow is described.

In an outer tub 1, a cylindrical drum 2 having perforations is placed to rotate freely, and an intake path 3*a*, an exhaust path 3*b* and a solvent discharge pipe 4 are connected to the wall of the outer tub 1. The intake path 3*a*, the outer tub 1, the exhaust path 3*b* and an upper vent path 3*c* forms a vent circulatory path, wherein the air flows as indicated by arrows in FIG. 1 owing to a blower 5 driven by a blower motor 6. A gate valve 7 provided between the upper vent path 3*c* and the intake path 3*a* can open and close the vent circulatory path. An air inlet 8 with an intake valve 9 is provided in the immediate downstream of the gate valve 7. An exhaust outlet 10 is provided between the exhaust path 3*b* and the upper vent path 3*c*.

According to this structure, when the blower 5 is operated with the intake valve 9 opened and the gate valve 7 closed, the air entering from the air inlet 8 goes through the intake path 3*a*, the outer tub 1 and the exhaust path 3*b*, and is discharged from the exhaust outlet 10 (this flow of air is called an "exhaust system"). On the other hand, when the blower 5 is operated with both the intake valve 9 and the gate valve 7 opened, the air entering from the air inlet 8 goes through the intake path 3*a*, the outer tub 1 and the exhaust path 3*b*, and a part of the air is discharged from the exhaust outlet 10. The rest circulates back to the intake path 3*a* through the upper vent path 3*c* (this flow of air is called the "circulative exhaust system"). Further, when the blower 5 is operated with the intake valve 9 closed and the gate valve 7 opened, the air circulates through the intake path 3*a*, the outer tub 1, the exhaust path 3*b* and the upper vent path 3*c* (this flow of air is called the "closed exhaust system").

In the intake path 3*a*, a steam healing type drying heater 11 is installed and a temperature sensor ("drum inlet temperature sensor") 12 is placed in the downstream of the drying beater 11. High-temperature steam (normally 100 to 120° C.) from a boiler (not shown in the figure) provided outside of the dry cleaning machine is supplied to the pipe running in the drying heater 11 when necessary, and the steam flows back to the boiler. Owing to this structure, the air passing through the intake path 3*a* is heated and sent to the outer tub 1. The drum outlet temperature sensor placed in the exhaust path 3*b* measures the air temperature passing through the drum 2.

A drying cooler 14 is provided in the upper vent path 3*c* and a temperature sensor ("cooler temperature sensor") 15 is placed in the downstream of the drying cooler 14. The coolant condensed and liquefied by a refrigerator 18, which is placed outside of the drycleaner is circulatively supplied to the pipe running in the heat exchanger in the drying cooler 14 when necessary. When the air sent from the exhaust path 3*b* is rapidly cooled by the heat exchanger in the drying cooler 14, the solvent gas included in the air condenses into liquid and drops down. The liquefied solvent flows from a drain outlet 16 to a water separator 17, where water is removed and only the solvent is collected into a solvent tank 20.

A discharge pipe 4 attached to the bottom of the outer tub 1 is connected to a button trap 19 which is equipped with a standard level switch 19*a* and a drainage level switch 19*b*. The standard level switch 19*a* detects that the solvent level in the drum 2 is appropriate, and the drainage level switch 19*b* detects that the solvent in the outer tub 1 is discharged. This drainage level switch 19*b* is an example of the solvent remain detection means in the present invention. The button trap 19 is a kind of filter to remove debris such as a clothing button contained in the discharged solvent An outlet 20*a* of the solvent tank 20 and an outlet 19*c* of the button trap 19 are both connected to an inlet of a pump 21 through a valve VL1 and a valve VL2 respectively. The outlet of this pump 21 is selectively connected, through a check valve 22, either to the inlet or to the outlet of a filter 23 by a first three-way valve VL3. The filter 23 consists of a paper filter, an activated carbon filter and other components, and takes out impurities included in the solvent.

The outlet of the filter 23 is also connected to a solvent cooler 24. The solvent cooler 24 has a heat exchanger equipped with a coolant pipe through which the coolant is circulatively supplied from the refrigerator 18 when necessary and the heat exchanger cools the solvent. A solvent temperature sensor 25 and a soap concentration sensor 26 are provided in the downstream of this solvent cooler 24, The passage in the further downstream is selectively connected either to the outer tub 1 or to the solvent tank 20 by a second three-way valve VL4. A soap tank 27 is connected to the inlet of the pump 21 through a soap supplying valve VL5, and the outlet of the filter 23 is connected to the upper part of the solvent tank 20 through a solvent drain valve VL6.

The refrigerator 18, a heat pump type refrigerator, is equipped with a compressor and a condenser. The compressor compresses the coolant gas and change it to a high-temperature, high-pressure coolant gas, and the condenser deprives the high-temperature coolant gas of heat under a high pressure, so that the coolant gas is condensed and liquefied. The liquefied coolant is supplied through a coolant pipe, which is the coolant delivery means of the present invention, which branches into two: one is connected to the solvent cooler 24 through a coolant valve VC1 and an expansion valve VE1 for the solvent cooler, and the other is connected to the drying cooler 14 through a coolant valve VC2 and an expansion valve VE2 for the drying cooler. The expansion valve VE1 and VE2 both decreases the pressure of the high pressure liquid coolant and turn it into a low-temperature, low-pressure liquid. The liquid coolant deprives the solvent or the air of heat in the heat exchanger, and evaporates. Thus it reverts to a low-temperature, low-pressure gas. The coolant pipes in which the coolant gas flows back from the solvent cooler 24 and the drying cooler 14 are joined and connected to the refrigerator 18. Accordingly, the liquid solvent is selectively supplied either to the solvent cooler 24 or to the drying cooler 14 by controlling the coolant valve for the solvent cooler VC1 and the coolant valve for the drying cooler VC2, whereby the heat exchanger of a selected cooler works.

In the cooling system using the known refrigerating cycle, it is necessary to give an adequate heat load to the heat exchanger commensurate with its refrigerating capacity. If the heat load is too small compared to the refrigerating capability, sufficient heat is not given to the liquid coolant. The coolant can not evaporate completely and returns to the refrigerator in a liquid state, which causes such problems that too much burden is imposed on the compressor, or the coolant pipes running in the heat exchanger gather heavy frost. Therefore, in this drycleaner, the heat exchanger of the drying cooler 14 and that of the solvent cooler 24 are designed to have almost the same heat exchange capacity. And the heat exchange capacity of each heat exchanger is commensurate with the refrigerating capacity of the refrigerator 18. Such conditions are satisfied by appropriately determining the surface area of pipes contributing to heat exchange in each heat exchanger.

Consequently, whichever the coolant is supplied to the solvent cooler 24 or to the drying cooler 14, heat load does not change so much, which can prevent overload on the compressor and surface frosting on the pipes. However, the heat load depends on the amount of circulating airflow in the drying cooler 14 or the amount of circulating solvent in the solvent cooler 24. According to this structure, these parameters (the amount of circulating airflow, the amount of circulating solvent, or other factors) are made controllable to a certain degree. By appropriately adjusting the parameters in accordance with the variable factors effecting the refrigerating ability of the refrigerator 18 such as an ambient temperature, the load on the compressor of the refrigerator 18 can be reduced further.

In the solvent circulating pass constructed as above, when the solvent is supplied to the outer tub 1, the drain valve VL2 is closed, the supplying valve VL1 is opened, the outlet of the solvent cooler 24 and the outlet of pump 21 are connected to the outer tub 1 by the second three-way valve VL4 and to the filter 23 by the first three-way valve VL3 respectively, and the pump 21 is operated. The solvent drain valve VL6 is kept closed, Then the solvent stored in the solvent tank 20 is supplied to the outer tub 1 through the supplying valve VL1, the pump 21, the first three-way valve VL3, the filter 23, the solvent cooler 24 and the second three-way valve VL4 (hereinafter referred to as a "solvent supplying path").

On the other hand, when the solvent stored in the outer tub 1 is discharged, the dram valve VL2 is opened, the supplying valve VL1 is closed, the outlet of the pump 21 and the outlet of the solvent cooler 24 are connected to the inlet of the filter 23 by the first three-way valve VL3 and to the solvent tank 20 by the second three-way valve by VL4 respectively, and the pump 21 is operated. Then the solvent flows back from the outer tub 1 and through the discharge pipe 4, the button trap 19, the drain valve VL2, the pump 21, the first three-way valve VL3, the filter 23, the solvent cooler 24 and the second three-way valve VL4 to the solvent tank 20. This solvent circulating path corresponds to the "first path" in the present invention (hereinafter referred a to a "solvent discharging path"). In this case, the solvent can be purified by the filter 23 in the process of returning to the solvent tank 20. At the same time, supplying the coolant to the solvent cooler 24 (or making the solvent cooler 24 function as a cooling means) can lower the solvent temperature.

When the solvent is not supplied to the outer tub 1, the supplying valve VL1 is opened, the drain valve VL2 is closed, the outlet of the pump 21 and the outlet of the solvent cooler 24 are connected to the inlet of the filter 23 by the first thee-way valve VL3 and to the solvent tank 20 by the second three-way valve VL4 respectively, and the pump 21 is operated. Then the solvent circulates through the supplying valve VL1, the pump 21, the first three-way valve VL3, the filter 23, the solvent cooler 24 and the second three-way valve VL4 into the solvent tank 20. This solvent circulating path corresponds to the second piping path in the present invention (hereinafter referred to as a "solvent circulating path"). The solvent can be purified by the filter 23 in the process of circulating. As is the case with the above solvent discharging path, the solvent also can be cooled when the solvent cooler 24 is working. Considering the case that the solvent temperature is lower than the target temperature (about 25° C. for instance), a solvent heater to heat the solvent to the desired temperature may be provided, too.

Referring next to FIG. 2, the electric system of this drycleaner will be described. A controller 40 consists of a microcomputer or others having CPU, ROM storing the operation control program and RAM to read and write data necessary for operation. An operating section 42 equipped with key input switches, a display 43 equipped with an numerical data display panel and the above-mentioned components such as the drum inlet temperature sensor 12, the drum outlet temperature sensor 13, the cooler temperature sensor 15, the solvent temperature sensor 25, the standard level switch 19*a*, the drainage level switch 19*b* and the soap concentration sensor 26 are connected to the controller 40.

The controller 40 receives detection signals from the above sensors and switches, outputs control signals to a load actuator 41 according to the operation control program and operates the refrigerator 18, a drum motor 2*a*, the blower motor 6, the pump 21, the intake valve 9,the gate valve 7, the supplying valve VL1, the drain valve VL2, the first three-way valve VL3, the second three-way valve VL4, the soap supplying valve VL5, the solvent drain valve VL6, the coolant valve for the solvent cooler VC1 and the coolant valve for the drying cooler VC2 through the load actuator 41. A thermistor is used as a temperature sensor connected to the controller 40.

Referring now to FIG. 3 to FIG. 6, the operations of this drycleaner will be described in line with the process of cleaning.

(1) Washing Step (step S1)

When a start key on the operating section 42 is operated by the operator and the commencement of an operation is directed, the controller 40 drives the drum motor 2*a* to rotate the drum 2 forward and backward intermittently at a low speed (30–50 rpm). At the same time, the aforesaid solvent supplying path is formed, supplying the solvent from the solvent tank 20 to the outer tub 1 until the outer tub 1 is filled with a predetermined amount of solvent.

When the standard level switch 19*a* detects that the solvent level has reached the predetermined level, the supplying valve VL1 is closed and the drain valve VL2 is opened. Then the solvent stored in the outer tub 1 circulates through the discharge pipe 4, the drain valve VL2, the pump 21, the first three-way valve VL3, the filter 23, the solvent cooler 24 and the second three-way valve VL4 into the outer tub 1. While the laundry is tumble-washed in the drum 2 rotating forward and backward, the solvent is circulatively supplied to the outer tub 1 as above, and debris from the laundry are collected by the button trap 19. Further, the solvent is purified by the filter 23. During the washing operation, in order to improve the washing efficiency and prevent charge-up of static electricity, which will be described later, soap is supplied to an appropriate concentration. The soap supply is achieved by opening the soap supplying valve VL5 while the pump 21 is being operated.

During the above washing step, the drying cooler 14 is not used. Thus, when necessary (for example, when the solvent temperature measured by the solvent temperature sensor 25 exceeds a predetermined temperature), the refrigerator 18 is operated, the coolant valve for the solvent cooler VC1 is opened and the coolant valve for the drying cooler VC2 is closed, whereby the coolant is supplied to the solvent cooler 24 to cool the solvent During the washing step, the solvent temperature can easily rise due to heat conduction from outside in the course of circulating as explained above, but, in the present invention, the solvent is appropriately cooled at the solvent cooler 24 and the solvent temperature is prevented from rising too high.

(2) Extracting Step (step S2)

After a predetermined washing operation period (7 minutes, for instance), the solvent discharging path is formed as above, and the solvent in the outer tub 1 is collected to the tank 20. When the drainage level switch 19*b* detects that the discharging operation has finished for the present, the drum 2 is rotated in the normal (forward) direction at a high speed (400–600 rpm), whereby the solvent is extracted from the laundry by the centrifugal force. At this time, the discharging operation is continued as described below and the solvent extracted from the laundry is collected to the solvent tank 20. After a predetermined extracting operation period, the drum 2 is stopped and the extracting step is completed.

On the other hand, during the exacting step, the coolant path is controlled according to the procedure illustrated in FIG. 5. By determining that the drainage level switch 19*b* is OFF, it is determined that the solvent in the outer tub 1 has been discharged (step S21). If the drainage level switch 19*b* is not OFF, the solvent is considered to remain in the outer tub 1. In this case, the drain valve VL2 is turned ON, the supplying valve VL1 is turned OFF, the refrigerator 18 is turned ON, the coolant valve for the solvent cooler VC1 is turned ON, the coolant valve for the dying cooler VC2 is turned OFF and the pump 21 is turned ON, so that the solvent discharged from the outer tub 1 is collected to the solvent tank 20 after passing through the solvent cooler 24 (step S24).

In the above step S21, when the drainage level switch 19*b* is determined to be OFF, the solvent in the outer tub is assumed to have been completely discharged. In this condition, the pump 21 will idle and the solvent will not go to the solvent cooler 24. Then the controller 40 turns the drain valve VL2 OFF and the supplying valve VL1 ON while the refrigerator 18 is maintained ON, the coolant valve for the solvent cooler VC1 ON, the coolant valve for the drying cooler VC2 OFF and the pump 21 ON. By this measures, the solvent withdrawn from the solvent tank 20 by the operation of the pimp 21 is supplied to the solvent cooler 24 and circulates back to the solvent tank 20 after passing through the solvent cooler 24 (step S22). When the solvent discharged from the laundry is accumulated at the bottom of the outer tub 1 by the rapidly rotating drum 2 as described above, the drainage level switch 19*b* is tuned ON again, so that the process of either the above-mentioned step S22 or S24 is executed until the predetermined extracting operation period passes ("Y" in step S23). As a result, the solvent is necessarily supplied to the solvent cooler 24, avoiding the risk of an excessive decrease in the beat load on the solvent cooler 24.

(3) Circulating Drying Step (step S3)

After the extracting step, as the first drying process, a circulating drying step begins. In the circulating drying step, the controller 40 rotates the drum 2 forward and backward intermittently at a low speed and drives the blower motor 6 and the drying heater 11. Further, the refrigerator 18 is turned ON, the coolant valve for the solvent cooler VC1 is turned OFF, and the coolant valve for the drying cooler VC2 is turned ON, whereby the coolant is supplied to the drying cooler 14 and the drying cooler 14 becomes operable. At the same time, the intake valve 9 is closed and the gate valve 7 is opened. The dry hot air is supplied to the outer tub 1 and the air containing the solvent gas evaporated from the laundry circulates back to the drying cooler 14 through the perforations of the drum 2. The solvent gas is cooled in the drying cooler 14 and condensed to a liquid, so that the solvent-free dry air returns to the drying heater 11, where it is reheated and flows back to the outer tub 1.

In this circulating drying step, in order to securely prevent accidents such as catching fire, the temperature control is carried out to keep the concentration of the solvent in the circulating air under an appropriate safety level (for instance, when the solvent is the No. 5 gasoline, it must be under 0.6 vol %), The solvent gas concentration in the drum 2 depends on the difference between the temperature of the hot air measured by the drum inlet temperature sensor 12 and the temperature of the air measured by the dram outlet temperature sensor 13 after cooled by evaporating the solvent from the laundry. By controlling the volume of vapor supplied to the drying heater 11 to keep the temperature difference smaller than a predetermined value, the drying process can be accomplished while maintaining the solvent gas concentration in the drum 2 below the safety level.

(4) Exhausting Drying Step (step S4)

After the above circulating drying step is carried out for the predetermined period, an exhausting drying step follows. In the exhausting drying step, while the blower motor 6, the drying heater 11 and the refrigerator 18 are maintained in operation, it is determined whether the solvent temperature measured by the solvent temperature sensor 25 is above 25° C. as shown in FIG. 6 (step S41). When the solvent temperature is above 25° C., the coolant valve for the solvent cooler VC1 is turned ON, the coolant valve for the drying cooler VC2 is turned OFF, the gate valve 7 is closed and the intake valve 9 is opened. The above solvent circulating path is formed and the solvent is circulated. Consequently, the coolant is supplied to the solvent cooler 24, and the solvent is cooled there (step S42). If the gate valve 7 is not closed at this moment, a part of the air is not discharged from the exhaust outlet 10, and contacts the drying cooler 14 to which the coolant is not supplied. This causes a rise in the temperature of the drying cooler 14, and deteriorates the cooling efficiency at the beginning of the following cooling step. Further, if a part of the air that has passed through the outer tub 1 is not discharged to the outside and returns to the outer tub 1 again or repeatedly, the solvent gas concentration could increase gradually even though the concentration of the remaining solvent is very low. Closing the gate valve 7 breaks such a harmful air circulation, and prevents these problems.

If the solvent cooling operation was performed in the above step S42, the operation is continued until a predetermined exhausting drying operation period passes "Y" in step S43) and the next cooling step follows.

On the other hand, when the solvent temperature is below 25° C. in step S41, the coolant valve VC1 for the solvent cooler is turned OFF, the coolant valve for the drying cooler VC2 is turned ON, the gate valve 7 is opened and the intake valve 9 is opened. The coolant is continuously supplied to the drying cooler 14 as well as the above circulating drying step, so that a part of the air which was not discharged from the exhaust outlet 10 is cooled by a contact with the drying cooler 14, and the solvent contained in the air is condensed into liquid and collected (step S44). Again, this operation is continued until the predetermined exhaust drying step period passes ("Y" in step S45), and the next cooling operation follows.

(5) Cooling Step (step S5)

In the cooling step, the intake valve 9 is closed again, the drum 2 is rotated forward and backward, and the vapor supply to the drying heater 11 is halted to stop the heating operation. Further, the coolant valve for the solvent cooler VC1 is tuned OFF and the coolant valve for the drying cooler VC2 is turned ON, so that coolant is supplied to the drying cooler 14. The air is then cooled by the drying cooler 14 and supplied to the outer tub 1, whereby the temperature of the laundry is lowered (step S51).

(6) Deodorizing Step (step S6)

After the cooling step is carried out for a predetermined cooling operation period, the refrigerator 18 is turned OFF, and the operation of the drying cooler 14 is stopped. The intake valve 9 is completely opened, and the fresh air is supplied to the outer tub 1 from the outside to remove the solvent smell remaining in the laundry. Then the drum 2 is stopped, and all the cleaning processes are completed here.

Since the principal purpose of the above exhausting drying step is not retrieving the solvent or cooling the solvent, it is not necessary to operate the drying cooler 14 and the solvent cooler 24. Regarding the refrigerator 18, repeating ON/OFF operations in a short time period is hare especially for the compressor. It is recommended that an ON-period continues more than 5 minutes and an OFF-period continues more than 3 minutes. However, as shown in FIG. 4, in the circulating drying step and the cooling step which come before and after the exhausting drying step, the dying heater 14 needs to be operated. Since the cooling operation period is about 2 minutes, if the refrigerator 18 is turned OFF during this process, the above desirable ON/OFF duration condition can not be satisfied. Therefore, in the case of this drycleaner of the present embodiment, the refrigerator 18 is designed to keep ON, and the coolant liquefied by the refrigerator 18 is used either in the drying cooler 14 or in the solvent cooler 24, When the solvent temperature is high, it is used for cooling in the solvent cooler 24, and when the solvent temperature is not high, it is used for cooling in the drying cooler 14. This satisfies the desirable condition of ON/OFF duration periods of the refrigerator 18, and also the operation of the refrigerator 18 is effectively utilized during the exhausting drying operation.

While a preferred embodiment of the invention has been described, it will be obvious that various changes and modifications are possible within the scope of the invention.

What is claimed is:

1. A dry cleaning machine comprising:

an outer tub functioning as a washing chamber and a drying chamber;

a solvent circulating system for supplying solvent to the outer tub for washing while washing laundry and for retrieving the solvent;

an air path connecting an air outlet and an air inlet of the outer tub for supplying a heated air to the outer tub and for retrieving the air from the outer tub;

a refrigerator for compressing and liquefying a coolant;

a solvent cooler placed outside of the outer tub equipped with a heat exchanger for cooling the solvent using the coolant;

a drying cooler provided in the air path for cooling the air passing through the air path and for condensing the solvent included in the air using the coolant;

a coolant circulating system including a switch for supplying the coolant liquefied in the refrigerator selectively either to the solvent cooler or the drying cooler.

2. The dry cleaning machine according to claim 1, wherein the heat exchanging performance of the solvent cooler and that of the drying cooler are almost the same.

3. The dry cleaning machine according to claim 1 further comprising:

an air heater placed in the air path at a downstream of the drying cooler;

a closable air intake placed between the drying cooler and the air heater;

an air exit placed in the air path at an upstream of the drying cooler;

a gate valve placed between the drying cooler and the air intake;

an operation controller for performing processes of circulating drying step for drying the air and for retrieving the solvent contained in the air by opening the gate valve, closing the air intake and energizing the heater and the drying cooler to dry the air passing through the air path, exhausting drying step for drying air by opening the air intake, heating an outer air taken from the air intake, supplying the heated air to the outer drum through the air inlet, and discharging all or most of the air that has passed through the outer drum through the air exit, and cooling step for cooling the laundry by opening the gate valve, closing the air intake, de-energizing the heater, energizing the in cooler, supplying cool air from the air inlet to the outer tub, wherein the operation controller detects the temperature of the solvent when the exhausting drying step starts, and sets the switch so that the coolant is supplied to the solvent cooler when the detected temperature is higher than a predetermined value, and the coolant is supplied to the drying cooler when the detected temperature is not higher than the predetermined value.

4. The dry cleaning machine according to claim 3, wherein, in the exhausting drying step, the operation controller drives the gate valve to shut the air path when the detected temperature is higher than the predetermined value and the coolant is supplied to the solvent cooler, and the operation controller drives the gate valve to open the air path when the detected temperature is not higher than the predetermined value and the coolant is supplied to the drying cooler.

5. The dry cleaning machine according to claim 1, wherein the dry cleaning machine further comprises a solvent detector for detecting whether the solvent remains in the outer tub;

the solvent circulating system comprises a solvent tank, a first path for retrieving the solvent discharged from the outer tub to the solvent tank through the solvent cooler, and a second path for taking the solvent out of the solvent tank and for returning the solvent to the solvent tank through the solvent cooler; and the first path and the second path are selectively used depending on the result of the detection whether the solvent remains in the outer tub when the solvent is discharged from the outer tub and is retrieved to the solvent tank in a extracting step.

6. The dry cleaning machine according to claim 1, wherein the a rotatable drum is provided in the outer drum, and washing and drying of the laundry is performed by rotating the drum with the laundry in it.

* * * * *